US008957604B2

(12) United States Patent
Harish Gopala Pillai et al.

(10) Patent No.: US 8,957,604 B2
(45) Date of Patent: Feb. 17, 2015

(54) SYSTEM AND METHOD FOR IMPLEMENTING MAINS-SIGNAL-BASED DIMMING OF SOLID STATE LIGHTING MODULE

(75) Inventors: Raman Nair Harish Gopala Pillai, Arlington Heights, IL (US); Kaustuva Acharya, Bartlett, IL (US); Ajay Tripathi, Libertyville, IL (US)

(73) Assignee: Koninklijke Philips N.V., Eindhoven (NL)

( * ) Notice: Subject to any disclaimer, the term of this patent is extended or adjusted under 35 U.S.C. 154(b) by 0 days.

(21) Appl. No.: 14/234,519

(22) PCT Filed: Jul. 24, 2012

(86) PCT No.: PCT/IB2012/053755

§ 371 (c)(1),
(2), (4) Date: Jan. 23, 2014

(87) PCT Pub. No.: WO2013/014607

PCT Pub. Date: Jan. 31, 2013

(65) Prior Publication Data

US 2014/0176008 A1 Jun. 26, 2014

Related U.S. Application Data

(60) Provisional application No. 61/511,245, filed on Jul. 25, 2011.

(51) Int. Cl.
*H05B 37/02* (2006.01)
*H05B 33/08* (2006.01)

(52) U.S. Cl.
CPC ..... *H05B 33/0803* (2013.01); *H05B 33/0809* (2013.01); *H05B 33/0815* (2013.01); *H05B 33/0887* (2013.01)
USPC ..... 315/294; 315/291; 315/307; 315/308; 315/224; 315/247; 315/276

(58) Field of Classification Search
CPC .. H05B 37/02; H05B 37/029; H05B 33/0803; H05B 33/0815; H05B 33/0851; H05B 33/0869; H05B 41/2821; H05B 41/2827; H05B 41/2828; H05B 41/2855
USPC ..... 315/119, 192, 206, 227 R, 224, 247, 315/276, 291, 294, 307, 308, 312
See application file for complete search history.

(56) References Cited

U.S. PATENT DOCUMENTS 5,661,645 A 8/1997 Hochstein
8,217,588 B2 * 7/2012 McKinney ..... 315/291

(Continued)

FOREIGN PATENT DOCUMENTS

WO 2010008709 A1 1/2010
WO 2010069983 A1 6/2010
WO 2011159813 A1 12/2011

*Primary Examiner* — Haiss Philogene
(74) *Attorney, Agent, or Firm* — Yuliya Mathis

(57) ABSTRACT

A system for implementing mains-voltage-based dimming of a solid state lighting module includes a transformer, a mains sensing circuit and a processing circuit. The transformer includes a primary side connected to a primary side circuit and a secondary side connected to a secondary side circuit, the primary and second side circuits being separated by an isolation barrier. The mains sensing circuit receives a rectified mains voltage from the primary side circuit and generates a mains sense signal indicating amplitude of the rectified mains voltage. The processing circuit receives the mains sense signal from the mains sensing circuit across the isolation barrier, and outputs a dimming reference signal to the secondary side circuit in response to the mains sense signal. Light output by the solid state lighting module, connected to the secondary side circuit, is adjusted in response to the dimming reference signal output by the processing circuit.

20 Claims, 5 Drawing Sheets

(56) References Cited

U.S. PATENT DOCUMENTS

| | | | | |
|---|---|---|---|---|
| 8,362,713 | B2 * | 1/2013 | Recker et al. | 315/293 |
| 8,552,662 | B2 * | 10/2013 | Sun et al. | 315/294 |
| 2008/0018261 | A1 * | 1/2008 | Kastner | 315/192 |
| 2010/0148673 | A1 | 6/2010 | Stewart et al. | |
| 2010/0308749 | A1 | 12/2010 | Liu | |
| 2011/0062877 | A1 | 3/2011 | Yang et al. | |
| 2011/0068703 | A1 | 3/2011 | McKinney | |
| 2011/0068704 | A1 | 3/2011 | McKinney | |
| 2013/0038227 | A1 * | 2/2013 | Yan et al. | 315/186 |
| 2014/0091723 | A1 * | 4/2014 | Kuo et al. | 315/200 R |
| 2014/0285103 | A1 * | 9/2014 | Acharya et al. | 315/206 |

* cited by examiner

SYSTEM AND METHOD FOR IMPLEMENTING MAINS-SIGNAL-BASED DIMMING OF SOLID STATE LIGHTING MODULE

TECHNICAL FIELD

The present invention is directed generally to control of solid state lighting devices. More particularly, various inventive methods and apparatus disclosed herein relate to implementing mains-signal-based dimming of a solid state lighting module.

BACKGROUND

Digital lighting technologies, i.e., illumination based on semiconductor light sources, such as light-emitting diodes (LEDs), offer a viable alternative to traditional fluorescent, HID, and incandescent lamps. Functional advantages and benefits of LEDs include high energy conversion and optical efficiency, durability, lower operating costs, and many others. Recent advances in LED technology have provided efficient and robust full-spectrum lighting sources that enable a variety of lighting effects in many applications.

In order to retrofit LED module applications in conventional outdoor light fixtures, the traditional mains-dimmable magnetic ballast must be replaced, e.g., using an LED driver connected between the mains voltage supply and the LED module. In order to enable dimming of light output by the LEDs based on the mains voltage (as is used in conventional magnetic dimming applications), the LED driver senses the mains voltage and reduces the output current based on the sensed voltage. The LED driver may include a power transformer with primary side and secondary side circuits separated by an isolation barrier. Therefore, information regarding the dimmed mains voltage on the primary side of the isolation barrier must be sent over the isolation barrier to a controller on the secondary side of the isolation barrier.

Thus, there is a need in the art for a mains dimming technique using simple circuitry for mains voltage sensing and transmitting mains dimming information to a controller across an isolation barrier.

SUMMARY

The present disclosure is directed to inventive apparatus and method for mains dimming using circuitry for sensing dimmed mains voltage on a primary side of an LED driver, and accurately transmitting the dimmed mains voltage information to a controller on a secondary side of the LED driver across an isolation barrier. Using the dimmed mains voltage information, various schemes for dimming LED module current may be implemented.

Generally, in one aspect, a system for implementing mains-voltage-based dimming of a solid state lighting module includes a transformer, a mains sensing circuit and a processing circuit. The transformer includes a primary side connected to a primary side circuit and a secondary side connected to a secondary side circuit, the primary and second side circuits being separated by an isolation barrier. The mains sensing circuit receives a rectified mains voltage from the primary side circuit and generates a mains sense signal indicating amplitude of the rectified mains voltage. The processing circuit receives the mains sense signal from the mains sensing circuit across the isolation barrier, and outputs a dimming reference signal to the secondary side circuit in response to the mains sense signal. Light output by the solid state lighting module, connected to the secondary side circuit, is adjusted in response to the dimming reference signal output by the processing circuit.

In another aspect, a method of providing mains-signal-based dimming of a light-emitting diode (LED) module includes generating a mains sensing signal indicating amplitude of a rectified mains voltage from a primary side circuit, connected to a primary side of a power transformer; transmitting the mains sensing signal across an isolation barrier corresponding to the power transformer; generating a dimming feedback signal in a secondary side circuit, connected to a secondary side of the power transformer, based at least in part on the transmitted mains sensing signal. The dimming feedback signal is transmitted from the secondary side circuit across the isolation barrier to the primary side circuit. A drive current of the LED module output by the secondary side circuit is then adjusted based on the dimming feedback signal transmitted to the primary side circuit.

In another aspect, a mains-signal-based driver for dimming an LED module includes a transformer having a primary side and a secondary side, a primary side circuit connected to the primary side of the transformer, a secondary side circuit connected to the secondary side of the transformer, and dimming control circuit. The primary side circuit includes a voltage rectifier configured to rectify a dimmed mains voltage. The secondary side circuit is configured to output a drive current for driving the LED module, and includes an output current control. The secondary side circuit is separated from the primary side circuit by an isolation barrier. The dimming control circuit includes a mains sensing circuit configured to generate a mains sense signal indicating amplitude of the rectified mains voltage; an optical isolator configured to provide electrical coupling across the isolation barrier; and a microprocessor configured to receive the mains sense signal from the mains sensing circuit via the optical isolator, to generate a current reference signal in response to the mains sense signal and to output the current reference signal to the output current control. The output current control generates a dimming feedback signal based on a comparison of the current reference signal and the drive current, and transmits the dimming feedback signal to the primary side circuit across the isolation barrier. The primary side circuit adjusts an input to the transformer in response to the dimming feedback signal, thereby adjusting the drive current in the secondary side circuit.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources (including one or more LEDs as defined above).

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "lighting fixture" is used herein to refer to an implementation or arrangement of one or more lighting units in a particular form factor, assembly, or package. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present invention discussed herein. The terms "program" or "computer program" are used herein in a generic sense to refer to any type of computer code (e.g., software or microcode) that can be employed to program one or more processors or controllers.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

In the following detailed description, for purposes of explanation and not limitation, representative embodiments disclosing specific details are set forth in order to provide a thorough understanding of the present teachings. However, it will be apparent to one having ordinary skill in the art having had the benefit of the present disclosure that other embodiments according to the present teachings that depart from the specific details disclosed herein remain within the scope of the appended claims. Moreover, descriptions of well-known apparatuses and methods may be omitted so as to not obscure the description of the representative embodiments. Such methods and apparatuses are clearly within the scope of the present teachings.

Applicants have recognized and appreciated that it would be beneficial to provide a circuit capable of sensing dimmed mains voltage on a primary side of an LED driver and transmitting information regarding the sensed dimmed mains voltage over an isolation barrier to a processor or controller on a secondary side of the LED driver.

Mains-voltage-based dimming schemes are used, for example, in magnetic ballasts of conventional lighting applications. When retrofit LED modules are used to replace magnetic ballasts, it is desirable that dimming continue to be performed using the mains voltage, as well. According to mains-voltage-based dimming schemes, the amount of light output is reduced as the mains voltage is reduced, e.g., via a dimming controller. For LEDs, dimming is achieved by changing an output current provided to the LEDs in response to changes in the mains voltage, e.g., via the dimming controller. Different mains voltage dimming schemes may be implemented, such as bi-level dimming, in which the light output switches between two levels depending on the level of the mains voltage, and linear dimming, in which the light output decreases linearly as the level of the mains voltage is reduced.

Figure 1:
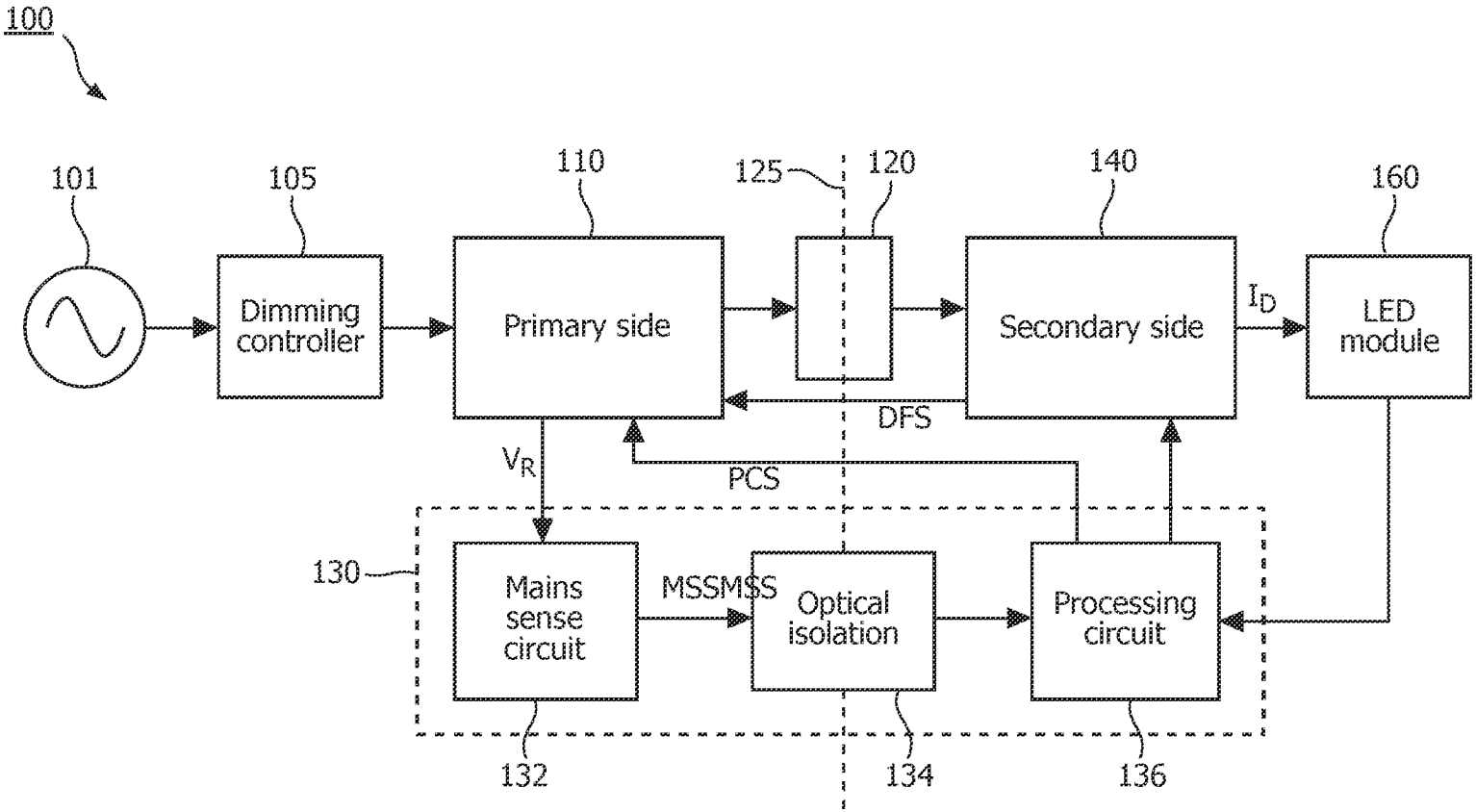
FIG. 1 is a simplified block diagram showing a driver for a mains-signal-based, dimmable solid state lighting system, according to a representative embodiment.

FIG. 1 is a simplified block diagram showing a driver for a dimmable lighting system, according to a representative embodiment.

Referring to FIG. 1, driver 100 for implementing mains-voltage-based dimming of a solid state lighting module, indicated as LED module 160, includes an isolating transformer 120 having a primary side connected to a primary side circuit 110 and a secondary side connected to a secondary side circuit 140. For example, the transformer 120 may be a high-frequency/high power transformer, such that isolation may be achieved when the LED module 160 is implemented as a high brightness LED module. The primary side circuit 110 receives a dimmed mains voltage from mains voltage source 101 via dimming controller 105, which may be sine dimming controller, for example. As discussed in detail below, the primary side circuit 110 includes a voltage rectifier (not shown in FIG. 1) for receiving the dimmed mains voltage and providing rectified mains voltage $V_R$. The secondary side circuit 140 is connected to the LED module 160, and outputs an adjustable drive current $I_D$ to the LED module 160 based on primary side current $I_{pri}$ and induced secondary side current $I_{sec}$ of the transformer 120.

The driver 100 further includes dimming control circuit 130 connected to both the primary side circuit 110 and the secondary side circuit 140 across isolation barrier 125, which corresponds to the transformer 120. The dimming control circuit 130 includes mains sensing circuit 132, isolator 134 and processing circuit 136. The mains sensing circuit 132 is configured to receive rectified mains voltage $V_R$ from the voltage rectifier in the primary side circuit 110, and to generate mains sense signal MSS indicating the amplitude of the rectified mains voltage $V_R$. The mains sensing circuit 132 transmits the mains sense signal MSS to the processing circuit 136 across the isolation barrier 125 via the isolator 134. The isolator 134 may be an optical isolator, for example, which enables information (e.g., the mains sense signal MSS) to be exchanged using light signals, while maintaining electrical isolation across the isolation barrier 125. Thus, the isolator 134 may be implemented accurately using low cost bi-level opto-isolators, for example. In alternative embodiments, coupling across the isolation barrier 125 may be obtained using other types of isolation, such as transformers, without departing from the scope of the present teachings.

The processing device 136 is located across the isolation barrier 125 from the primary side circuit 110 because the processing device 136 senses signals from the LED module 160, as well as other dimming controllers (not shown) and provides supervisory reference commands to the secondary circuit 140, as discussed below. For example, in the depicted configuration, the processing circuit 136 receives the mains sense signal MSS from the mains sensing circuit 132 and outputs one or more dimming reference signals to the secondary side circuit 140, determined at least in part based on the mains sense signal MSS. The dimming reference signals may include a current reference signal $I_{ref}$ and/or a voltage reference signal $V_{ref}$, for example, as discussed below. The processing circuit 136 may also receive a dimming control signal, indicating a set dimming level, and one or more LED feedback signals from the LED module 160, including light level, temperature, and the like. The dimming reference signals are generated by the processing circuit 136 in response to at least the mains sense signal MSS, and in various embodiments, also in response to the dimming control signal and/or the LED feedback signals.

The secondary side circuit 140 receives the dimming reference signals, and compares the dimming reference signals with corresponding electrical conditions. The secondary side circuit 140 generates a dimming feedback signal DFS based on the results of the comparison, and transmits the dimming feedback signal DFS to the primary side circuit 110 across the isolation barrier 125, e.g., via another isolator (not shown in FIG. 1). For example, when the dimming control signals include current reference signal $I_{ref}$, an output current control (not shown) of the secondary side circuit 140 compares the current reference signal $I_{ref}$ with the drive current $I_D$ being supplied to the LED module 160. The secondary side circuit 140 then generates a dimming feedback signal DFS that indicates the difference, if any, between the reference signal $I_{ref}$ and the drive current $I_D$.

The dimming feedback signal DFS is transmitted to the primary side circuit 110 across the isolation barrier 125 via another isolator (not shown in FIG. 1). In response to the dimming feedback signal DFS, the primary side circuit 110 adjusts a primary side voltage $V_{pri}$ input to the primary side of the transformer 120, as needed, which in turn adjusts a secondary voltage $V_{sec}$ through the secondary side of the transformer 120 and thus the drive current $I_D$ output by the secondary circuit 140 to the LED module 160. Accordingly, the drive current $I_D$ drives the LED module 160 to provide the amount of light corresponding to the setting of the dimming controller 105. In an embodiment, the processing circuit 136 may also provide a power control signal PCS to the primary side circuit 110 across the isolation barrier 125 via another isolator (not shown in FIG. 1), which selectively controls application of power to the primary side circuit 110 and the secondary side circuit 140, as discussed below with reference to FIG. 4.

In various embodiments, the processing circuit 136 may be implemented as a controller or microcontroller, for example, including a processor or central processing unit (CPU), application specific integrated circuits (ASICs), field-programmable gate arrays (FPGAs), or combinations thereof, using software, firmware, hard-wired logic circuits, or combinations thereof. When using a processor or CPU, a memory (not shown) is included for storing executable software/firmware and/or executable code that controls operations of the processing circuit 136. The memory may be any number, type and combination of nonvolatile read only memory (ROM) and volatile random access memory (RAM), and may store various types of information, such as computer programs and software algorithms executable by the processor or CPU. The memory may include any number, type and combination of tangible computer readable storage media, such as a disk drive, an electrically programmable read-only memory (EPROM), an electrically erasable and programmable read only memory (EEPROM), a CD, a DVD, a universal serial bus (USB) drive, and the like.

In an embodiment, the mains sense signal MSS output by the mains sensing circuit 132 is a pulse-width modulated (PWM) signal, which is transmitted to the processing circuit 136 through the isolator 134. The mains sensing circuit 132 may generate the PWM signal in a variety of ways. For example, FIG. 2 is a simplified block diagram of a mains sensing circuit, configured to generate a PWM signal, according to a representative embodiment.

Figure 2:
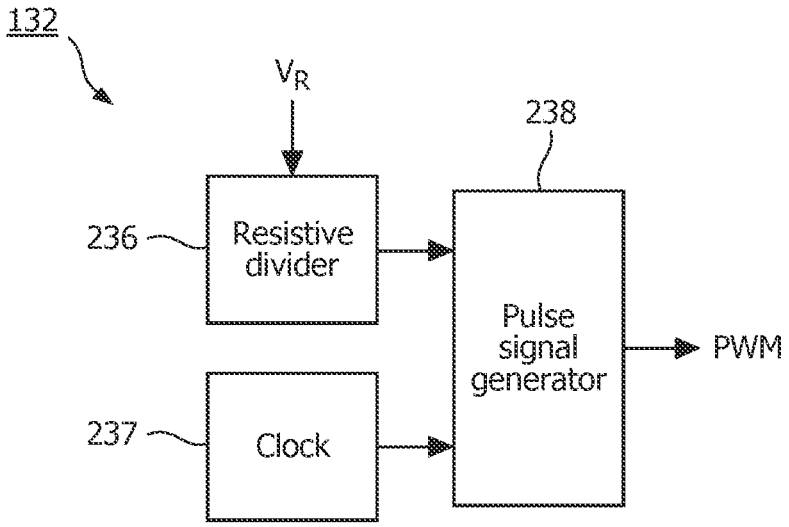
FIG. 2 is a simplified block diagram of an illustrative mains sensing circuit, configured to generate a PWM signal, according to a representative embodiment.

Referring to FIG. 2, the mains sensing circuit 132 includes resistive divider 236, clock 237 and pulse signal generator 238. The resistive divider 236 is configured to receive the rectified mains voltage $V_R$ from the voltage rectifier in the primary side circuit 110, and to provide a divided mains voltage to the pulse signal generator 238. The clock 237 is configured to generate a clock signal Clk, which is also provided to the pulse signal generator 238. The pulse signal generator 238 thus generates a PWM signal as the mains sense signal MSS, based on the divided mains voltage and the clock signal Clk, such that a width of each pulse of the PWM signal is modulated by the amplitude of the rectified mains voltage $V_R$. In an illustrative configuration, the clock 236 includes a first 555 timer and the pulse signal generator 238 includes a second 555 timer, for example, for generating the PWM signal.

Of course, other configurations of the mains sensing circuit 132 and/or the various components thereof may be incorporated without departing from the scope of the present teachings. For example, in an alternative embodiment, the mains sensing circuit 132 may be implemented as a microcontroller configured to generate the PWM signal. The microcontroller may include an analog-to-digital converter (ADC) configured to receive the rectified mains voltage $V_R$ from the voltage rectifier in the primary side circuit 110, and to provide the PWM signal in response. The microcontroller may also communicate with the secondary side circuit 140 using some form digital communication protocol, such as I2C or UART. The microcontroller may be a STM8S, available from ST, for example, although other types of microcontrollers may be incorporated without departing from the scope of the present teachings.

Figure 3:
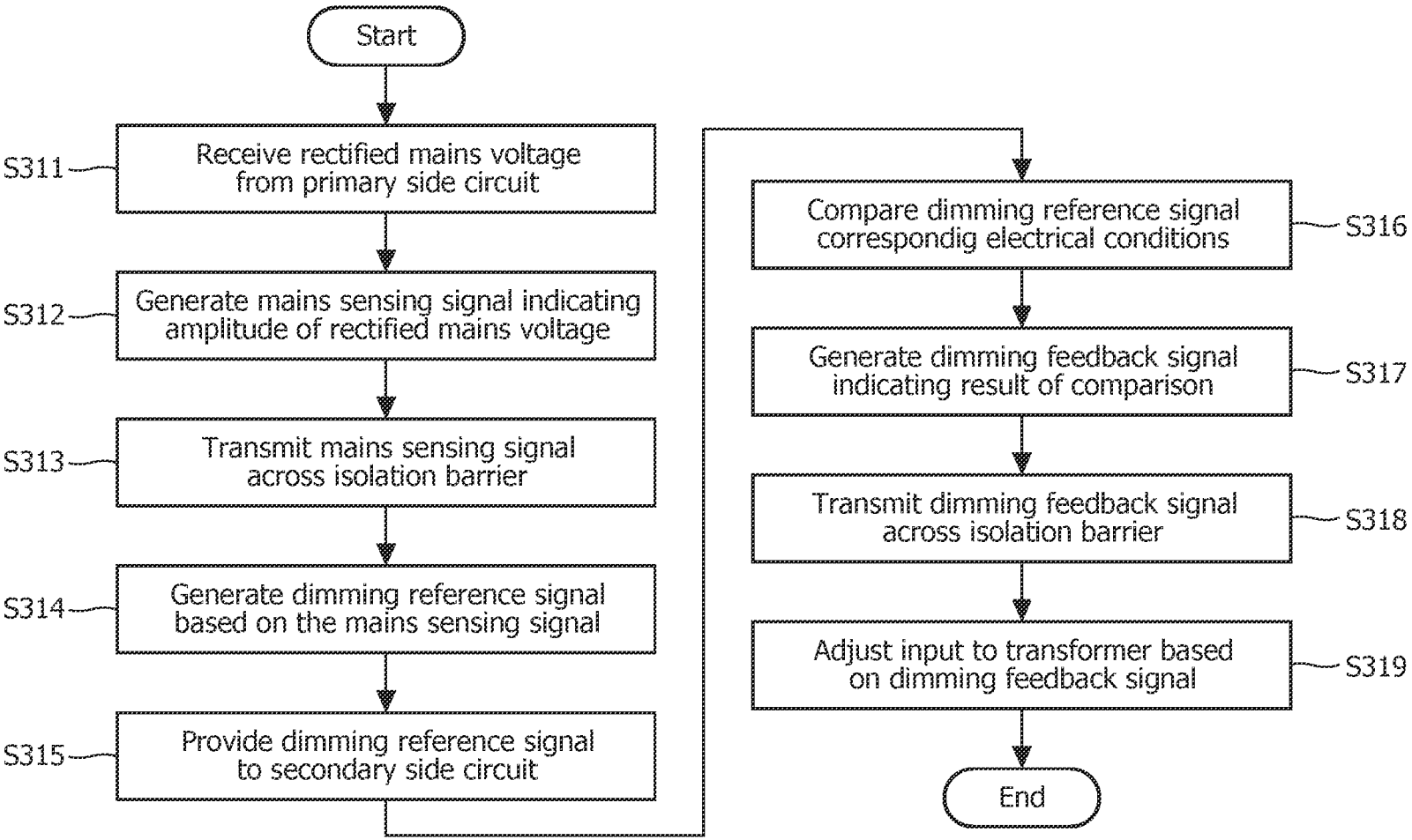
FIG. 3 is a simplified block diagram showing a driver for a mains-signal-based, dimmable solid state lighting system, according to a representative embodiment.

FIG. 3 is a flow diagram showing a process of dimming a solid state lighting load using mains dimming, according to a representative embodiment. The illustrative steps of FIG. 3 may be implemented by the driver 100 of FIG. 1, for example, although the steps may be implemented by any system having similar capabilities, without departing from the scope of the present teachings.

Referring to FIGS. 1 and 3, a rectified mains voltage $V_R$ from primary side circuit 110 is received by mains sensing circuit 132 at step S311. The mains sensing circuit 132 generates mains sensing signal MSS at step S312, which indicates amplitude of the rectified mains voltage $V_R$. The mains sensing signal MSS may be a PWM signal, for example, where the pulse widths are varied to correspond to the amplitude of the rectified mains voltage $V_R$. At step S313, the mains sensing signal MSS is transmitted across an isolation barrier, e.g, via isolator 134, to processing circuit 136.

At step S314, the processing circuit 136 generates one or more dimming reference signals based, at least in part, on the mains sensing signal MSS received from the mains sensing circuit 132. The dimming reference signals are provided the secondary side circuit 140 at step S315. For example, the dimming reference signals may include a current reference signal $I_{ref}$ and/or a voltage reference signal $V_{ref}$, which are respectively provided to an output current control and an output voltage control of the secondary side circuit 140. At step S316, the dimming reference signals are compared to corresponding electrical conditions of the secondary side circuit 140, and a dimming feedback signal DFS is generated at step S317 indicating the results of the comparison. For example, the current reference signal $I_{ref}$ would be compared to the drive current $I_D$ and the voltage reference signal $V_{ref}$ would be compared to the drive voltage $V_D$ driving the LED module 160. The dimming feedback signal DFS is transmitted to the primary side circuit 110 across the isolation barrier 125, e.g., via another isolator, at step S318. In response, at step S319, the primary side circuit 110 is able to make appropriate adjustments to the input, e.g., the primary side voltage $V_{pri}$ and/or the primary current $I_{pri}$, of the primary side of the transformer 120, causing corresponding adjustments to the drive current $I_D$ and/or drive voltage $V_D$ output by the secondary side circuit 140 to the LED module 160. Accordingly, the LED module 160 is driven to provide the appropriate amount of light corresponding to the setting of the dimming controller 105.

Figure 4:
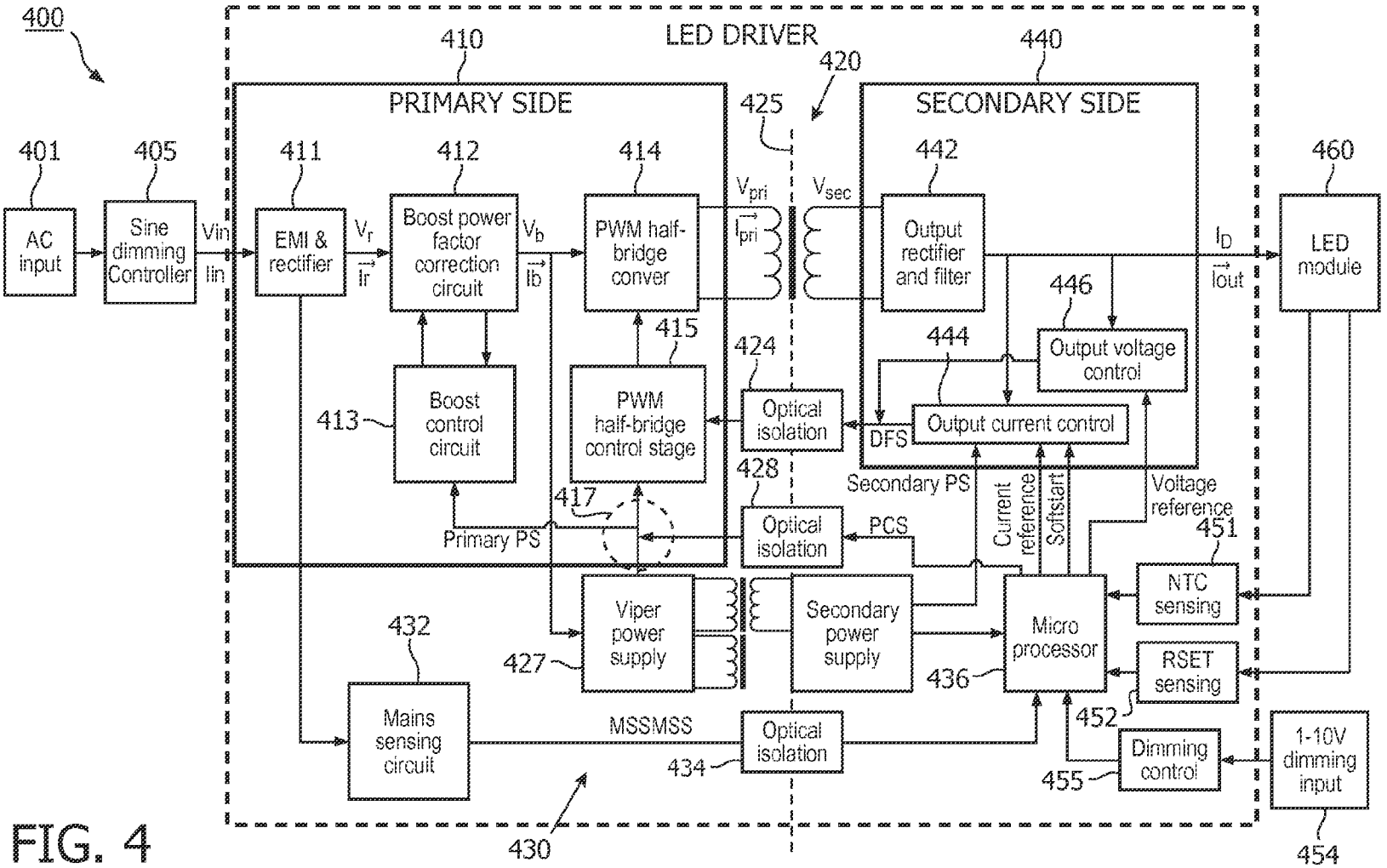
FIG. 4 is a flow diagram showing a process of mains-signal-based dimming a solid state lighting load, according to a representative embodiment.

FIG. 4 is a simplified block diagram showing a more detailed driver for a dimmable lighting system, according to a representative embodiment.

Referring to FIG. 4, driver 400 for implementing mains-voltage-based dimming of a solid state lighting module, indicated as illustrative LED module 460, includes an isolating transformer 420 having a primary side connected to a primary side circuit 410 and a secondary side connected to a secondary side circuit 440. The primary side circuit 410 receives dimmed mains voltage from mains voltage source 401 via dimming controller 405, which may be a sine dimming controller, for example. The secondary side circuit 440 is connected to the LED module 460, and outputs an adjustable drive current $I_D$ to the LED module 460 based on primary side current $I_{pri}$ of the transformer 420, as discussed below. The driver 400 further includes dimming control circuit 430 connected to both the primary side circuit 410 and the secondary side circuit 440 across isolation barrier 425, which corresponds to the transformer 420. The dimming control circuit 430 includes mains sensing circuit 432, first optical isolator 434 and microprocessor 436, discussed below.

The primary side circuit 410 includes voltage rectifier 411, boost power factor correction (PFC) circuit 412, boost control circuit 413, PWM half-bridge converter 414, and PWM half-bridge control stage 415. The voltage rectifier 411, and an EMI filter, is connected to the dimming controller 405. The voltage rectifier 411 therefore receives the dimmed mains voltage from the mains voltage source 401, and outputs rectified mains voltage $V_R$ (and corresponding rectified mains current $I_R$), thereby converting the AC mains voltage into a rectified sinusoidal waveform. The rectification is needed to create a constant DC voltage via the boost PFC circuit 412, discussed below. The EMI filter may include a network of inductors and capacitors (not shown) that limit the high frequency components injected into the line.

The rectified mains voltage $V_R$ is provided to the boost PFC circuit 412, which converts the rectified sinusoidal waveform of the rectified mains voltage $V_R$ to a fixed, regulated DC voltage, indicated as boosted voltage $V_B$ (and corresponding rectified boosted current $I_B$). In addition, the boost PFC circuit 412 ensures that the rectified mains current $I_R$ drawn from the voltage rectifier 411 and input to the boost PFC circuit 412 is in phase with the rectified mains voltage $V_R$. This ensures that the driver 400 operates close to unity power factor. The boost control circuit 413 controls the switches of a boost converter in the boost PFC circuit 412 accordingly.

The PWM half-bridge converter 414 converts the DC boosted voltage $V_B$ received from the boost PFC circuit 412 to a high-frequency pulsating signal, primary side voltage $V_{pri}$ (and corresponding pulsed primary side current $I_{pri}$), under control of the PWM half-bridge control stage 415. The primary side voltage $V_{pri}$ may be a PWM signal, for example, having a pulse width set by operation of switches (not shown) in the PWM half-bridge converter 414. The primary side voltage $V_{pri}$ is applied to the primary side (primary winding) of the transformer 420. The PWM half-bridge control stage 415 determines the pulse width of the primary side voltage $V_{pri}$ to be implemented by the PWM half-bridge converter 414 based on a dimming feedback signal DFS received from at least one of output current control 444 and output voltage control 446 of the secondary circuit 440, as discussed below.

Secondary side voltage $V_{sec}$ (and corresponding secondary side current $I_{sec}$) is induced in the secondary side (secondary winding) of the transformer 420 by the primary side voltage $V_{pri}$. The secondary side voltage $V_{sec}$ is rectified and high-frequency filtered by output rectifier/filter circuit 442 included in the secondary side circuit 440 to obtain the desired drive voltage $V_D$ and corresponding drive current $I_D$ for driving the LED module 360. The magnitude of the drive current $I_D$ in particular dictates the illumination level of the one or more LEDs in the LED module 460.

The secondary side circuit 440 further includes output current control 444 and output voltage control 446. The output current control 444 compares the drive current $I_D$ with a current reference signal $I_{ref}$ output by the microprocessor 436 to obtain a current difference ΔI, and the output voltage control 446 compares the drive voltage $V_D$ with a voltage reference signal $V_{ref}$ also output by the microprocessor 436 to obtain a voltage difference ΔV. A drive compensator (not shown) determines the dimming feedback signal DFS based on at least one of the current difference ΔI and the voltage difference ΔV. The microprocessor 436 determines the values of the current and voltage reference signals $I_{ref}$ and $V_{ref}$ based on the mains sense signal MSS received from the mains sensing circuit 432, discussed below, which in turn is based on the dimming level set at the dimming controller 405.

The output current control 444 may also receive a softstart signal (short pulse) from the microprocessor 436, which saturates the current control loop via output current control 444. After the softstart signal goes low, the current reference signal $I_{ref}$ from the microprocessor 436 is gradually increased in order to avoid flicker in the output LED current. During startup, the current difference ΔI may be determined as the current reference signal $I_{ref}$ less the drive current $I_D$ and the softstart signal, and the voltage difference ΔV may be determined as the voltage reference signal $V_{ref}$ less the drive voltage $V_D$ and the softstart signal.

As mentioned above, the dimming feedback signal DFS indicates both the current difference ΔI and the voltage difference ΔV provided by the output current control 444 and the output voltage control 446, respectively. In an embodiment, only the current loop (using the current difference ΔI) is typically active. If output voltage goes beyond a predefined limit, the voltage loop (using the voltage difference ΔV) may be used to reduce output current through the dimming feedback signal DFS. The dimming feedback signal DFS is provided from the secondary side circuit 440 to the PWM half-bridge control stage 415 across the isolation barrier 425 via the second optical isolator 424 (which may be the same as or different than the first optical isolator 434). The dimming feedback signal DFS thus controls the PWM half-bridge converter 414 to adjust the pulse width of the primary side voltage $V_{pri}$ based on dimming feedback signal DFS. For example, if the drive current $I_D$ exceeds the current reference signal $I_{ref}$, as indicated by the dimming feedback signal DFS, the PWM half-bridge control stage 415 will control the PWM half-bridge converter 414 to reduce the primary side voltage $V_{pri}$, and thus the primary current $I_{pri}$ as well, for example, by reducing the pulse width of the same. The change in the primary side voltage $V_{pri}$ is reflected in a corresponding change in the secondary voltage $V_{sec}$, as well as the drive voltage $V_D$ and the drive current $I_D$ output by the driver 400 for driving the LED module 460. Thus, the PWM half-bridge control stage 415 is able to regulate the drive voltage $V_D$ and/or the drive current $I_D$ of the driver 400 to a certain value. Under normal steady-state operation, the current reference signal $I_{ref}$ from the microprocessor 436 depends on the desired dim level, as indicated by the mains sense signal MSS.

The boosted voltage $V_B$ output by the boost PFC circuit 412 is also provided to power supply 427, which may be a step down DC-DC converter, such as a Viper power supply, for example. The power supply 427 may step down the boosted voltage $V_B$ to a lower voltage, such as 18V. The primary side of the power supply 427 is configured to selectively provide a regulated voltage to the various components of the primary side circuit 410 (e.g., voltage rectifier 411, boost PFC circuit 412, boost control circuit 413, PWM half-bridge converter 414, PWM half-bridge control stage 415) under control of switch 417. The operation and timing of the switch 417 (On/Off) is determined by power control signal PCS output by the microprocessor 436, and received by the switch 417 across the isolation barrier 425 via third optical isolator 428 (which may be the same as or different than the first and second optical isolators 434, 424). The secondary side of the power supply 427 is configured to provide a regulated voltage to the various components of the secondary side circuit 440 (e.g., output rectifier/filter circuit 442, output current control 444, output voltage control 446). In an illustrative configuration, the power supply 27 may be a flyback converter with two isolated outputs: one for the primary side and one for the secondary side.

The driver 400 further includes dimming control circuit 430 connected to both the primary side circuit 410 and the secondary side circuit 440 across isolation barrier 425, which corresponds to the transformer 420. The dimming control circuit 430 includes mains sensing circuit 432, first optical isolator 434 and microprocessor 436. As discussed above, the mains sensing circuit 432 is configured to receive the rectified mains voltage $V_R$ from the voltage rectifier 411, and to generate the mains sense signal MSS indicating the amplitude of the rectified mains voltage $V_R$. The mains sensing circuit 432 transmits the mains sense signal MSS to the microprocessor 436 across the isolation barrier 425 via the first optical isolator 434. The mains sensing circuit 432 may be implemented in a variety of configurations, including a pulse signal generator (e.g., as discussed above with reference to FIG. 2) or a microcontroller.

The microprocessor 436 is configured to receive the mains sense signal MSS from the mains sensing circuit 432 and to determine the current reference signal $I_{ref}$ and the voltage reference signal $V_{ref}$ in response. In addition, the microprocessor 436 is configured to receive a dimming signal from dimming input 454 through dimming control interface 455, where the dimming signal indicates the desired level of dimming, e.g., set by the user. For example, the dimming input 454 may provide a dimming scale from 1V to 10V, where 1V indicates maximum dimming (lowest level of output light) and 10V indicates minimum or no dimming (highest level of output light). The microprocessor 436 may receive multiple dimming level inputs, including the dimming input 454 and the dimming controller 405, and sets current reference signal $I_{ref}$ and/or the voltage reference signal $V_{ref}$ in response. In an embodiment, the microprocessor 436 linearly translates the mains sense signal MSS to obtain the current reference signal $I_{ref}$, for example, although the translation may be bi-level, logarithmic, any predefined set of table values, etc. The microprocessor 436 also receives feedback from the LED module 460, e.g., via negative temperature coefficient (NTC) sensing circuit 451 and RSET sensing circuit 452. The NTC sensing circuit 451 senses the temperature of the LED module 460, and the RSET sensing circuit 452 senses the value of an external resistor which also sets the reference current $I_{ref}$.

In addition, the microprocessor 436 generates the power control signal PCS, which is a low level switch signal used to turn ON/OFF the primary side supply and hence the LED driver 400. For example, the power control signal PCS may be used to turn OFF the LED driver 400 when a standby command is received from an external input. A specific value of the mains sense signal MSS may also signify a standby command. The power control signal PCS is sent by the microprocessor 436 to the primary side circuit 410 across the isolation barrier 425 via the third optical isolator 428 to operate the switch 417, discussed above.

Figure 5:
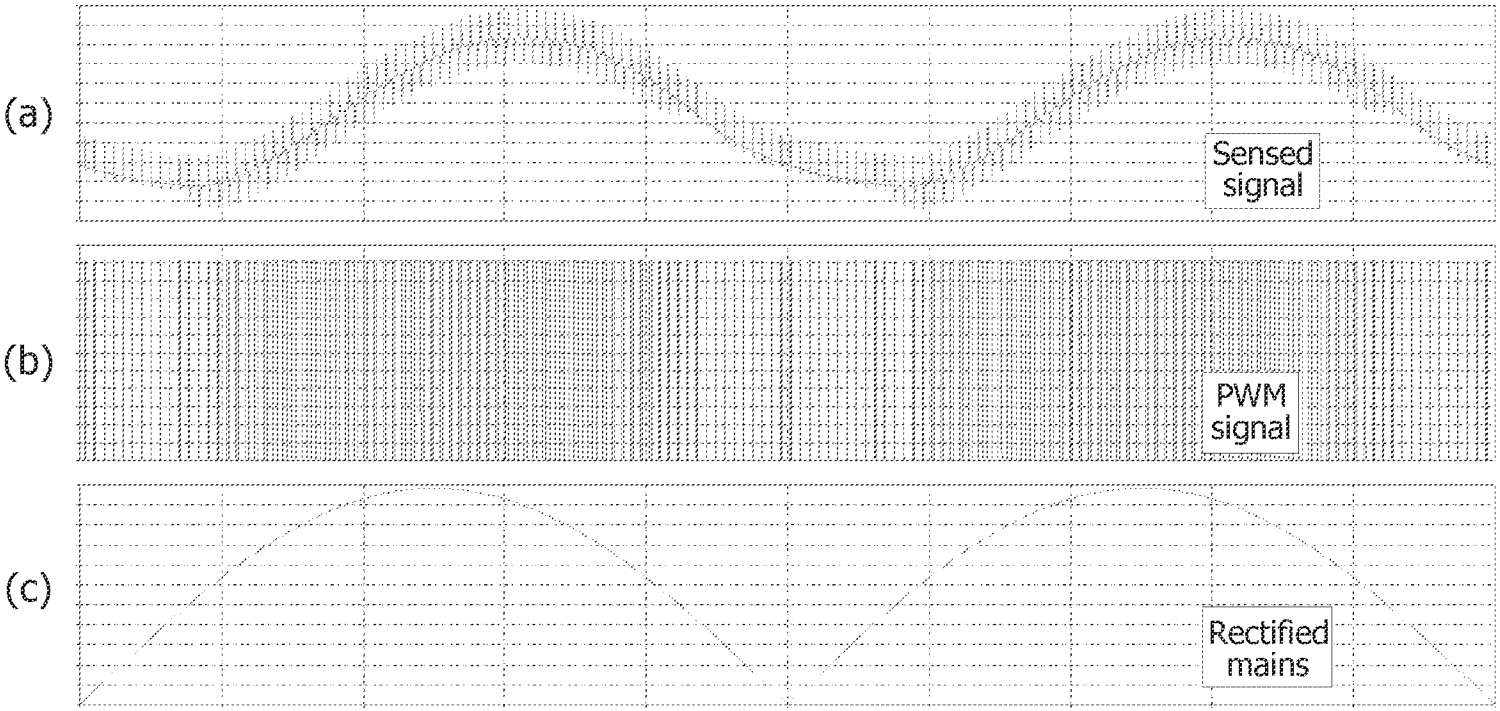
FIG. 5 is a set of graphs illustrating simulation results of a driver for a mains-signal-based, dimmable solid state lighting system, according to a representative embodiment.

FIG. 5 is a set of graphs illustrating simulation results of a driver for a dimmable solid state lighting system, according to a representative embodiment. In particular, graph 5(*c*) shows rectified mains voltage $V_R$ output by a voltage rectifier (e.g., voltage rectifier 411) in the primary side circuit. Graphs 5(*a*) and 5(*b*) respectively show the sensed signal and the corresponding PWM signal output by the mains sensing circuit (e.g., mains sensing circuit 432) as mains sense signal MSS in response to the rectified mains voltage $V_R$. The mains sense signal MSS is provided to a processing circuit (e.g., microprocessor 436) across an isolation barrier (e.g., isolation barrier 425) for determining dimming feedback signal DFS. As shown in FIG. 5, the rectified mains voltage $V_R$ is transmitted accurately over the isolation barrier.

The mains-signal-based, dimmable solid state lighting system driver discussed above may be applied to retrofit LED applications, where it is desired to control the light output based on the mains voltage signal. For example, the mains-signal-based, dimmable solid state lighting system driver may be used for applications in which the LED modules are replacing traditional magnetic ballasts.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. As used herein in the specification and in the claims, "or" should be understood to have the same meaning as "and/or" as defined above.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited. Also, reference numerals appearing in the claims, if any, are provided merely for convenience and should not be construed as limiting in any way.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

The invention claimed is:

1. A system for implementing mains-voltage-based dimming of a solid state lighting module, the system comprising:

a transformer comprising a primary side connected to a primary side circuit and a secondary side connected to a secondary side circuit, the primary side circuit being separated from the secondary side circuit by an isolation barrier;

a mains sensing circuit configured to receive a rectified mains voltage from the primary side circuit and to generate a mains sense signal indicating amplitude of the rectified mains voltage; and a processing circuit configured to receive the mains sense signal from the mains sensing circuit across the isolation barrier, and to output a dimming reference signal to the secondary side circuit in response to the mains sense signal, wherein light output by the solid state lighting module, connected to the secondary side circuit, is adjusted in response to the dimming reference signal output by the processing circuit.

2. The system of claim 1, further comprising a first optical isolator configured to couple the processing circuit with the mains sensing circuit across the isolation barrier.

3. The system of claim 2, further comprising an output current control in the secondary side circuit configured to receive the dimming reference signal, to compare the dimming reference signal with a drive current of the solid state lighting module, and to generate a dimming feedback signal based on a result of the comparison.

4. The system of claim 3, further comprising:

a second optical isolator configured to couple the output current control with the primary side circuit to enable transmission of the dimming feedback signal to the primary side circuit, wherein the light output by the solid state lighting module is adjusted in response to the dimming feedback signal.

5. The system of claim 4, wherein solid state lighting module comprises a plurality of light-emitting diodes (LEDs).

6. The system of claim 2, wherein the mains sense signal comprises a pulse-width modulated (PWM) signal, and the mains sensing circuit transmits the PWM signal to the processing circuit through the first optical isolator.

7. The system of claim 6, wherein the mains sensing circuit comprises a microcontroller configured to generate the PWM signal, the microcontroller comprising an analog-to-digital converter (ADC) configured to receive the rectified mains voltage.

8. The system of claim 3, wherein the mains sensing circuit comprises:

a resistive divider configured to receive the rectified mains voltage from the voltage rectifier and to provide a divided mains voltage;

a clock configured to generate a clock signal; and a pulse signal generator configured to generate the PWM signal based on the divided mains voltage and the clock signal, wherein a width of each pulse of the PWM signal is modulated by the amplitude of the rectified mains voltage.

9. The system of claim 8, wherein the clock comprises a first 555 timer and the pulse signal generator comprises a second 555 timer.

10. The system of claim 1, wherein an amount of light output by the solid state lighting module varies directly with the amplitude of the rectified mains voltage.

11. The system of claim 1, wherein the solid state lighting module comprises a retrofit light-emitting diode (LED) module configured to replace a conventional magnetic ballast.

12. A method of providing mains-signal-based dimming of a light-emitting diode (LED) module, the method comprising:

generating a mains sensing signal indicating amplitude of a rectified mains voltage from a primary side circuit, connected to a primary side of a power transformer;

transmitting the mains sensing signal across an isolation barrier corresponding to the power transformer;

generating a dimming feedback signal in a secondary side circuit, connected to a secondary side of the power transformer, based at least in part on the transmitted mains sensing signal;

transmitting the dimming feedback signal from the secondary side circuit across the isolation barrier to the primary side circuit; and adjusting a drive current of the LED module output by the secondary side circuit based on the dimming feedback signal transmitted to the primary side circuit.

13. The method of claim 12, wherein generating the dimming feedback signal comprises:

generating a dimming reference signal based at least in part on the transmitted mains sensing signal;

providing the dimming reference signal to the secondary side circuit;

comparing the dimming reference signal with at least one electrical condition in the secondary side circuit; and generating the dimming feedback signal to indicate a result of the comparison.

14. The method of claim 12, wherein adjusting the drive current of the LED module comprises:

adjusting at least one of a primary side voltage and a primary side current input to the primary side of the power transformer based on the dimming feedback signal, which results in a corresponding adjustment to at least one of a secondary side voltage and a secondary side current of the secondary side of the power transformer, wherein the drive current is based on the secondary side current.

15. The method of claim 12, wherein the mains sense signal comprises a pulse-width modulated (PWM) signal.

16. The system of claim 12, wherein the LED module comprises a retrofit LED module configured to replace a magnetic ballast.

17. A mains-signal-based driver for dimming a light-emitting diode (LED) module, the driver comprising:

a transformer having a primary side and a secondary side;

a primary side circuit connected to the primary side of the transformer, the primary side circuit comprising a voltage rectifier configured to rectify a dimmed mains voltage;

a secondary side circuit connected to the secondary side of the transformer and configured to output a drive current for driving the LED module, the secondary side circuit comprising an output current control, wherein the secondary side circuit is separated from the primary side circuit by an isolation barrier; and a dimming control circuit comprising a mains sensing circuit configured to generate a mains sense signal indicating amplitude of the rectified mains voltage; an optical isolator configured to provide electrical coupling across the isolation barrier; and a microprocessor configured to receive the mains sense signal from the mains sensing circuit via the optical isolator, to generate a current reference signal in response to the mains sense signal and to output the current reference signal to the output current control, wherein the output current control generates a dimming feedback signal based on a comparison of the current reference signal and the drive current, and transmits the dimming feedback signal to the primary side circuit across the isolation barrier, and wherein the primary side circuit adjusts an input to the transformer in response to the dimming feedback signal, thereby adjusting the drive current in the secondary side circuit.

18. The system of claim 17, wherein the mains sense signal comprises a pulse-width modulated (PWM) signal, and the mains sensing circuit transmits the PWM signal to the processing circuit through the first optical isolator.

19. The system of claim 18, wherein the mains sensing circuit comprises:

a resistive divider configured to provide a divided mains voltage from the rectified mains voltage;

a clock configured to generate a clock signal; and a pulse signal generator configured to generate the PWM signal based on the divided mains voltage and the clock signal, wherein a width of each pulse of the PWM signal is modulated by the amplitude of the rectified mains voltage.

20. The system of claim 18, wherein the mains sensing circuit comprises a microcontroller configured to generate the PWM signal, the microcontroller comprising an analog-to-digital converter (ADC) configured to receive the rectified mains voltage.

* * * * *